US008757727B2

(12) United States Patent
Leclaire

(10) Patent No.: US 8,757,727 B2
(45) Date of Patent: Jun. 24, 2014

(54) TABLE AND SEAT RESTRAINT APPARATUS

(75) Inventor: Lucien J. Leclaire, Albany, NY (US)

(73) Assignee: New York State Department of Corrections and Community Supervision, Albany, NY (US)

( * ) Notice: Subject to any disclaimer, the term of this patent is extended or adjusted under 35 U.S.C. 154(b) by 409 days.

(21) Appl. No.: 13/287,371

(22) Filed: Nov. 2, 2011

(65) Prior Publication Data

US 2013/0106146 A1 May 2, 2013

(51) Int. Cl.
*A62B 35/00* (2006.01)

(52) U.S. Cl.
USPC ..... 297/466; 297/172; 297/464

(58) Field of Classification Search
USPC ..... 297/172, 464, 466, 487
See application file for complete search history.

(56) References Cited

U.S. PATENT DOCUMENTS

| | | | | |
|---|---|---|---|---|
| 4,004,583 | A * | 1/1977 | Johnson | 297/468 |
| 4,930,842 | A * | 6/1990 | Wilkinson et al. | 297/466 |
| 5,499,844 | A * | 3/1996 | Dirck | 280/748 |
| 7,204,559 | B2 * | 4/2007 | Berra | 297/466 |
| 7,216,650 | B1 * | 5/2007 | Merriweather et al. | 128/879 |

OTHER PUBLICATIONS

Lance Mann, Parent Product: REDSK1620, Restart Desk 16"×20" w/o screen, Fishkill Corr. Facility, Jun. 29, 2009, 1 page.
Corcraft Product Information, Restart Desks for Classroom Therapy, Corcraft, Albany, NY, 3 pages.
Parent Product: REDSK1620, Restart Desk 16"x20" w/o screen, Fishkill Corr. Facility, Jun. 29, 2009, 1 page.
Corcraft Product Information, Restart Desks for Classroom Therapy, Corcraft, Albany, NY, Sep. 2005, 3 pages.

* cited by examiner

*Primary Examiner* — David R Dunn
*Assistant Examiner* — Richard Lowry
(74) *Attorney, Agent, or Firm* — Schmeiser, Olsen & Watts

(57) ABSTRACT

A table and seat assembly for limiting movement of ankle shackles by a client occupying the seat. The assembly includes a table supported by a first pedestal and the seat supported by a second pedestal, where the first and second pedestals are connected. A drive rod included in a locking mechanism extends from a linear sleeve bearing in the second pedestal and moves from an unlocked position in which the drive rod is not inside a receiver socket to a locking position in which the drive rod is inside the receiver socket. An individual positioned behind the seated client operates a foot pedal to move the drive rod between the unlocked and locking positions. When in the locking position, the drive rod prevents a chain or other connecting means of the ankle shackles from moving upwards between the guide socket and the receiver socket.

12 Claims, 5 Drawing Sheets

TABLE AND SEAT RESTRAINT APPARATUS

TECHNICAL FIELD

The present invention relates to a table and seat assembly that restrains the seat occupant, and more particularly to a table and seat apparatus for allowing a limited range of movement of a seated person who is wearing ankle shackles.

BACKGROUND

A known secure therapy desk offered by the New York State Department of Correctional Services (DOCS), Correctional Industries Program (a.k.a. Corcraft) is designed to secure a potentially disruptive inmate who is seated at the desk during a therapy session in a classroom environment. The known secure therapy desk allows the inmate a restricted amount of movement by means of a floor level locking device that secures ankle restraints worn by the inmate. The locking device is operated by moving a waist-level, hand-operated cam lever that moves a rod through a linear sleeve bearing in a first pedestal supporting the desk so that an end of the rod is received by a receiving socket mounted on a connector that connects the first pedestal to a second pedestal supporting a seat facing the desk. Before the rod is received by the receiving socket, the rod is in an unlocked position, and the chain of the ankle restraints is moved between the receiving socket and the first pedestal and placed below the receiving socket and above the connector. In response to the rod being received by the receiving socket, the rod is in a locking position where the chain is secured between the rod and the connector. The cam lever is positioned in front of the secure therapy desk (i.e., the cam lever is positioned substantially in front of the edge portion of the desk that is furthest from the seated inmate). The position and the hand operation of the cam lever limit the position and activities of a person who operates the cam lever. Thus, there exists a need to overcome at least one of the preceding limitations of the related art.

BRIEF SUMMARY

In one embodiment, the present invention provides a table and seat assembly for limiting movement of connecting means of ankle shackles being worn by a first person. The table and seat assembly comprises a table, a seat and a locking mechanism. The table includes a first pedestal. The seat includes a second pedestal having a linear sleeve bearing. Furthermore, the seat is occupied by the first person. The second pedestal is connected to the first pedestal. The locking mechanism includes a drive rod having a portion in the linear sleeve bearing, a foot pedal for moving the drive rod from a first position to a second position, a receiver socket for receiving the drive rod, and a guide socket for guiding the drive rod to the receiver socket. The foot pedal is configured for operation by a foot of a second person positioned behind the first person. The drive rod in the first position is at least partially through the guide socket but not inside the receiver socket. The drive rod in the second position is through the guide socket and inside the receiver socket. The drive rod in the first position is for moving the connecting means of the ankle shackles downward between the guide socket and the receiver socket. The drive rod in the second position is for limiting the movement of the connecting means of the ankle shackles so that the connecting means cannot move upwards between the guide socket and the receiver socket.

Advantageously, embodiments of the present invention provide a table and seat apparatus that confines a client wearing ankle shackles to the seat while allowing the seated client some freedom of movement and access to the table to participate in therapy and/or recreation in a group setting. The table and seat apparatus embodiments decrease the risk of the client distracting, disrupting or harming the person who is operating the locking mechanism that secures the ankle shackles to the table and seat apparatus.

DETAILED DESCRIPTION

Embodiments of the present invention provide a desk (a.k.a. table) and seat assembly that includes a locking mechanism that secures and limits the movement of a chain or other connecting means of ankle shackles worn by a client who is seated in the seat and who is using the desk while participating in a therapy or recreation session. While in a locked position, the locking mechanism includes a drive rod that allows the client to have a limited range of movement (i.e., limits the movement of the ankle shackles worn by the client). The drive rod is operated by a foot-operated pedal positioned to the rear of the seat. While an officer uses his or her foot to operate the foot pedal, and while the officer locks the drive rod in a locked position, the officer is behind the seated client. While the officer is operating the foot pedal, the officer and the seated client are not facing each other.

As used herein, a client is defined as a person who is secured by the restraint apparatus disclosed herein. In one embodiment, the client is a prisoner, detainee, inmate, or other person who is imprisoned, detained, or otherwise confined.

As used herein, ankle shackles are defined to be a physical restraint comprising a pair of rings or bands that are connected by a chain, bar or other connecting means, where the rings or bands are locked on or substantially close to the ankles of a client, and where the chain, bar or other connecting means has a length that allows the client to walk, while hindering the client from running and/or kicking. As used herein, ankle shackles include fetters, foot cuffs, leg cuffs, leg irons and leg shackles.

Figure 1:
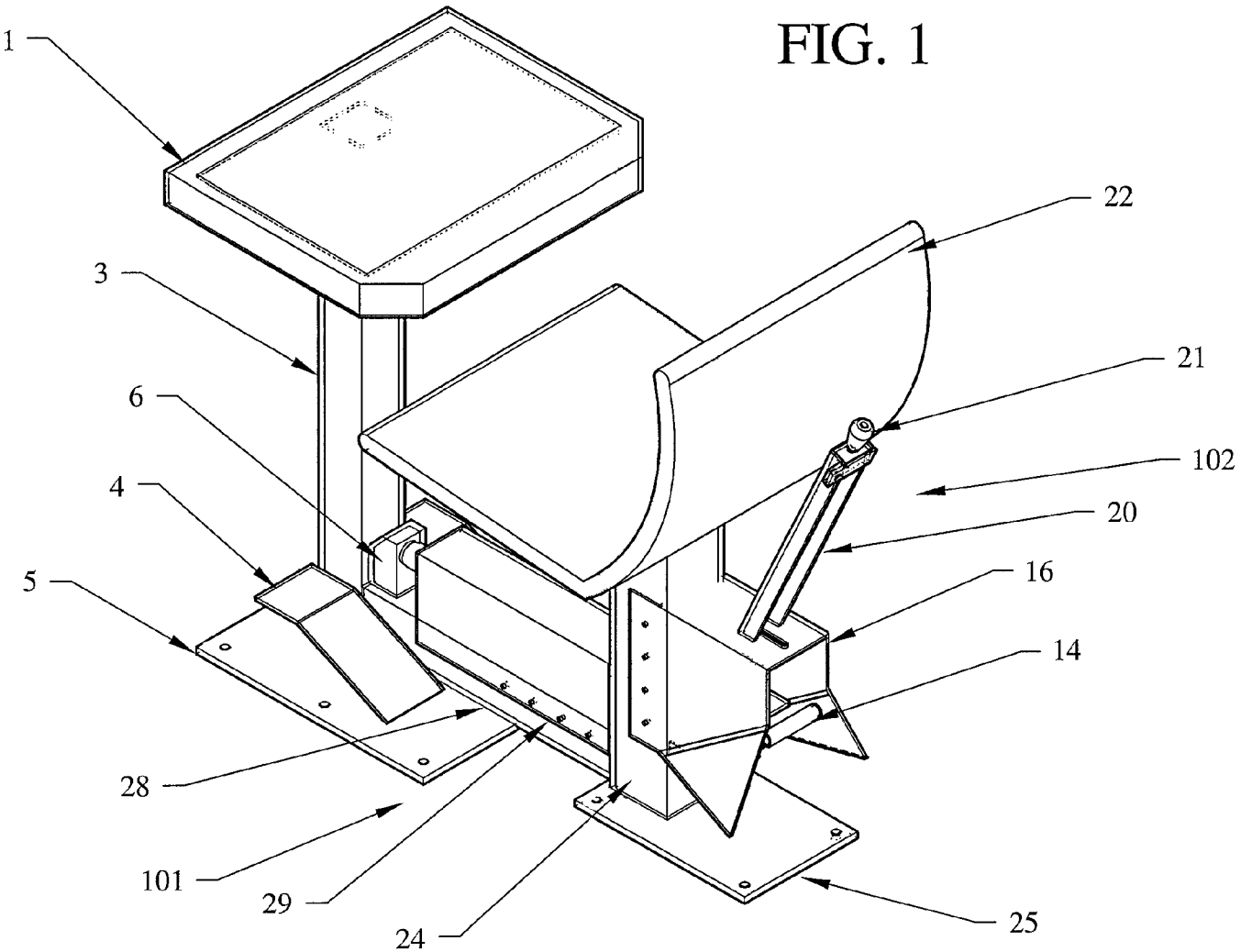
FIG. 1 is a perspective view of a table and seat assembly, in accordance with embodiments of the present invention.

FIG. 1 is a perspective view of a table and seat assembly, in accordance with embodiments of the present invention. The table and seat assembly includes a table portion that includes a desk top 1 supported by a desk top pedestal 3. The table and seat assembly also may include a foot rest 4 and another foot rest, where the foot rests are on opposing sides of pedestal 3. The desk top pedestal 3 and the foot rests are rigidly connected to a front base plate 5, which may be bolted to a rigid flooring surface.

Further, the table and seat assembly includes a locking mechanism 102 that includes actuating bolt assembly 101. Actuating bolt assembly 101 includes a receiver socket 6, a foot pedal 14, a foot assembly cover 16 and an actuating bolt cover 29. Receiver socket 6 receives a drive rod (not shown) covered by actuating bolt cover 29 and actuated by foot pedal 14, which is shielded by foot assembly cover 16.

Locking mechanism 102 also includes a linkage cover 20 that covers a lock linkage (not shown) connected to a knob 21. The locking mechanism 102 is operated to lock the drive rod in receiver socket 6.

Still further, the table and seat assembly includes a seat 22 supported by a seat pedestal 24, which is rigidly connected to a rear base plate 25, which may be bolted to the same rigid flooring surface to which front base plate 5 is bolted. A center linking tube 28 is rigidly connected to lower portions of sides of desk top pedestal 3 and seat pedestal 24.

Figure 2:
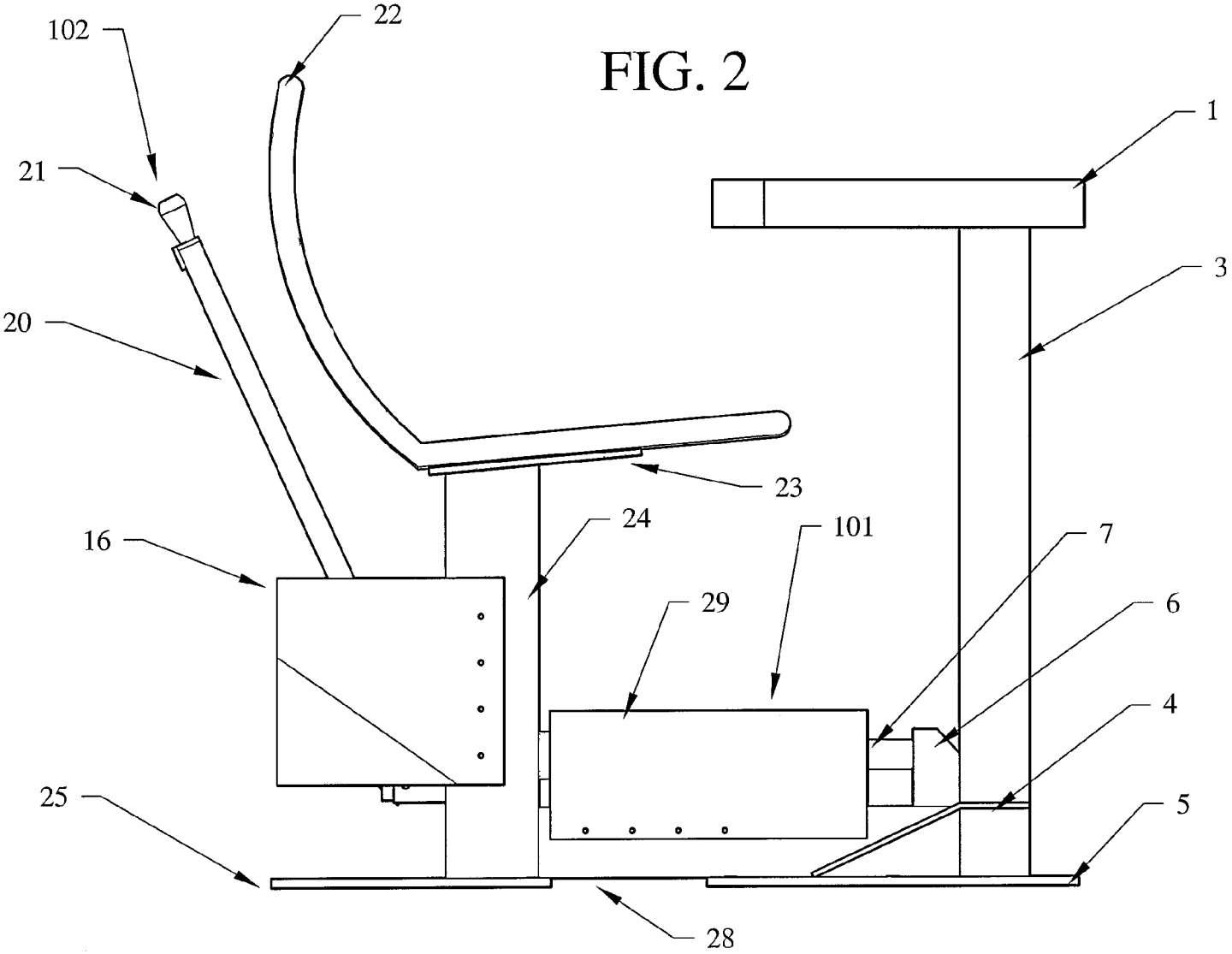
FIG. 2 is a side view of the table and seat assembly of FIG. 1, in accordance with embodiments of the present invention.

FIG. 2 is a side view of the table and seat assembly of FIG. 1, in accordance with embodiments of the present invention. The view of FIG. 2 depicts desk top 1, desk top pedestal 3, foot rest 4, front base plate 5, receiver socket 6, foot assembly cover 16, linkage cover 20, knob 21, seat 22, seat pedestal 24, rear base plate 25, center linking tube 28, actuating bolt cover 29, actuating bolt assembly 101, and locking mechanism 102, which are included in the view described above relative to FIG. 1.

Further, the side view in FIG. 2 depicts a drive rod 7 (i.e., the drive rod described above relative to FIG. 1) that is actuated by foot pedal 14 (see FIG. 1) and whose end portion is received by receiver socket 6 to secure a connecting means of ankle shackles being worn by a client seated in seat 22.

Still further, the side view in FIG. 2 depicts a seat mounting plate 23 that supports seat 22 and that is rigidly connected to seat pedestal 24.

Figure 3:
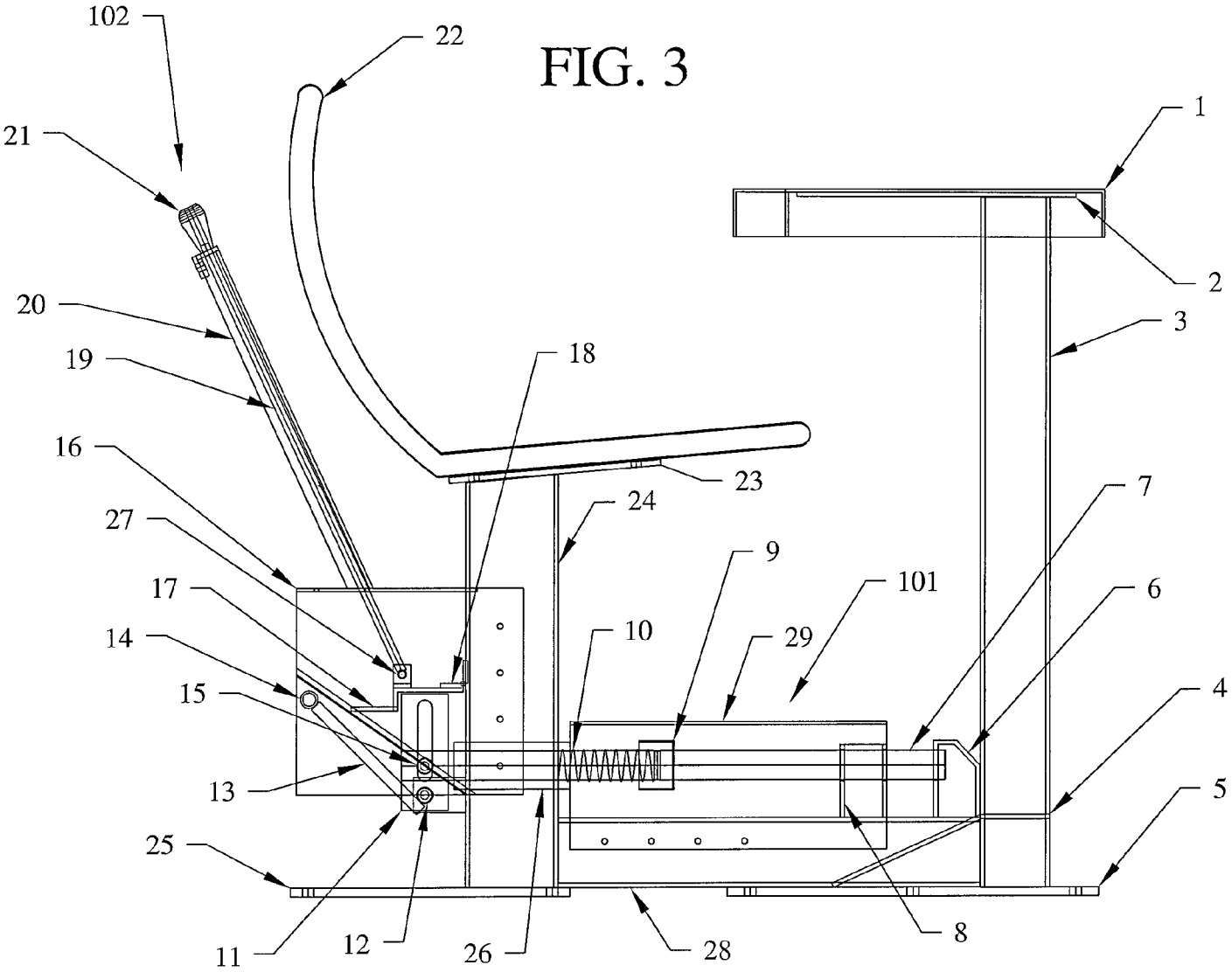
FIG. 3 is a cross section of the view of FIG. 2 and depicts a locking mechanism of the table and seat assembly of FIG. 1, in accordance with embodiments of the present invention.

FIG. 3 is a cross section of the view of FIG. 2, and depicts a locking mechanism of the table and seat assembly of FIG. 1, in accordance with embodiments of the present invention. The view of FIG. 3 depicts desk top 1, desk top pedestal 3, foot rest 4, front base plate 5, receiver socket 6, foot pedal 14, foot assembly cover 16, linkage cover 20, knob 21, seat 22, seat pedestal 24, rear base plate 25, center linking tube 28, actuating bolt cover 29, actuating bolt assembly 101, and locking mechanism 102, which are included in the view described above relative to FIG. 1. The view of FIG. 3 also depicts drive rod 7 and seat mounting plate 23, which are included in the view described above relative to FIG. 2.

Further, the view of FIG. 3 depicts a sub top 2 for supporting desk top 1, a guide socket 8 for guiding drive rod 7 to receiver socket 6, a die spring cage 9, a compression spring 10, a drive cam 11, a pivot 12, a lever arm 13 connected to foot pedal 14, a slide bushing 15, a cam lock 17, a lock hinge 18, a lock linkage 19, a linear sleeve bearing 26 mounted in seat pedestal 24, and a linkage pin 27.

In one embodiment, the table and seat assembly includes desk top 1, seat 22, and locking mechanism 102 that limits movement of a connecting means (e.g., a chain) of ankle shackles being worn by a client who is seated in seat 22, thereby restraining the client in a seated position facing an edge portion of desk top 1.

The inventive locking mechanism 102 includes actuating bolt assembly 101, which includes a drive rod 7 actuated by foot pedal 14, which is mounted to the rear of seat pedestal 24 so that a person who is operating foot pedal 14 is behind the client seated in seat 22. While the person is operating foot pedal 14, the person and the client seated in seat 22 are not facing each other. Locking mechanism 102 allows the person operating foot pedal 14 to actuate drive rod 7 from a first (i.e., unlocked) position (not shown) to a second (i.e., locking) position. In the first position, drive rod 7 is positioned in linear sleeve bearing 26 mounted in seat pedestal 24 and through (or partially through) a hole in guide socket 8. Guide socket 8 is rigidly connected to center linking tube 28 that connects seat pedestal 24 to the desk top pedestal 3. In the second position, which is shown in FIG. 3, drive rod 7 is positioned through the linear sleeve bearing 26 in seat pedestal 24 and through the hole in guide socket 8, with an end portion of drive rod 7 closest to the desk top pedestal 3 positioned inside receiver socket 6.

Compression spring 10 keeps constant pressure on the drive rod 7 so that drive rod 7 may be securely positioned in receiver socket 6 while the drive rod is in the second position. Drive rod 7 is locked in place in the second position by cam lock 17, thereby restraining the client by limiting the movement of the connecting means that connect the ankle shackles being worn by the client.

Actuating bolt assembly 101 is spring loaded and always rebounds to the locking position. While drive rod 7 is in the unlocked position, the chain or other connecting means of the ankle shackles is moved downward between guide socket 8 and receiver socket 6 until the chain or other connecting means is below a horizontal plane over which drive rod 7 may be moved between the unlocked and locking positions.

Releasing foot pedal 14 moves the drive rod 7 from the unlocked position to the locking position, thereby securing the chain or other connecting means between drive rod 7 and center linking tube 28, and between guide socket 8 and receiver socket 6. A person operating foot pedal 14 also operates lock linkage 19 to secure the chain or other connecting means with cam lock 17, thereby limiting potential movement of the ankle shackles being worn by the client seated in seat 22. In the second position of drive rod 7, the person places lock linkage 19 in a locked position (e.g., depresses lock linkage 19 by pressing on knob 21) to secure drive cam 11 so that the drive cam remains in a locked position until the drive cam is placed in an unlocked position by placing lock linkage 19 in an unlocked position (e.g., by lifting knob 21 to lift lock linkage 19).

An upper end portion of lock linkage 19 is connected to knob 21 (e.g., a plastic knob). A lower end portion of lock linkage 19 is connected to a linkage pin 27 that secures the lock linkage to cam lock 17. In response to lock linkage 19 being placed in its locked position, cam lock 17 completely prevents movement of drive cam 11 and drive rod 7, thereby securing drive rod 7 in the locking position. A top end portion of linkage cover 20 has a hasp, which may be locked with a padlock or another similar locking means to secure lock linkage 19 in its locked position and to prevent knob 21 from being lifted or otherwise moved into its unlocked position. To retract the drive rod 7 from being locked in the locking position to the unlocked position, the person operating foot pedal 14 and lock linkage 19 lifts or otherwise moves knob 21 to the knob's unlocked position while depressing foot pedal 14. After retracting drive rod 7 from the locking position to the unlocked position, the client moves the chain or other connecting means of the ankle shackles upwards between guide socket 8 and receiver socket 6 and over a horizontal plane under which drive rod 7 moves between the locking and unlocked positions, thereby ending the restraint of the client by the table and seat assembly.

In one embodiment, the table and seat assembly disclosed herein prevents the client from standing up from a seated position in seat 22 because locking mechanism 102 limits the movement of the chain of the ankle shackles worn by the client to a predetermined area and because of the relative positioning of a front edge portion of seat 22 and a rear edge portion of desk top 1.

Figure 4:
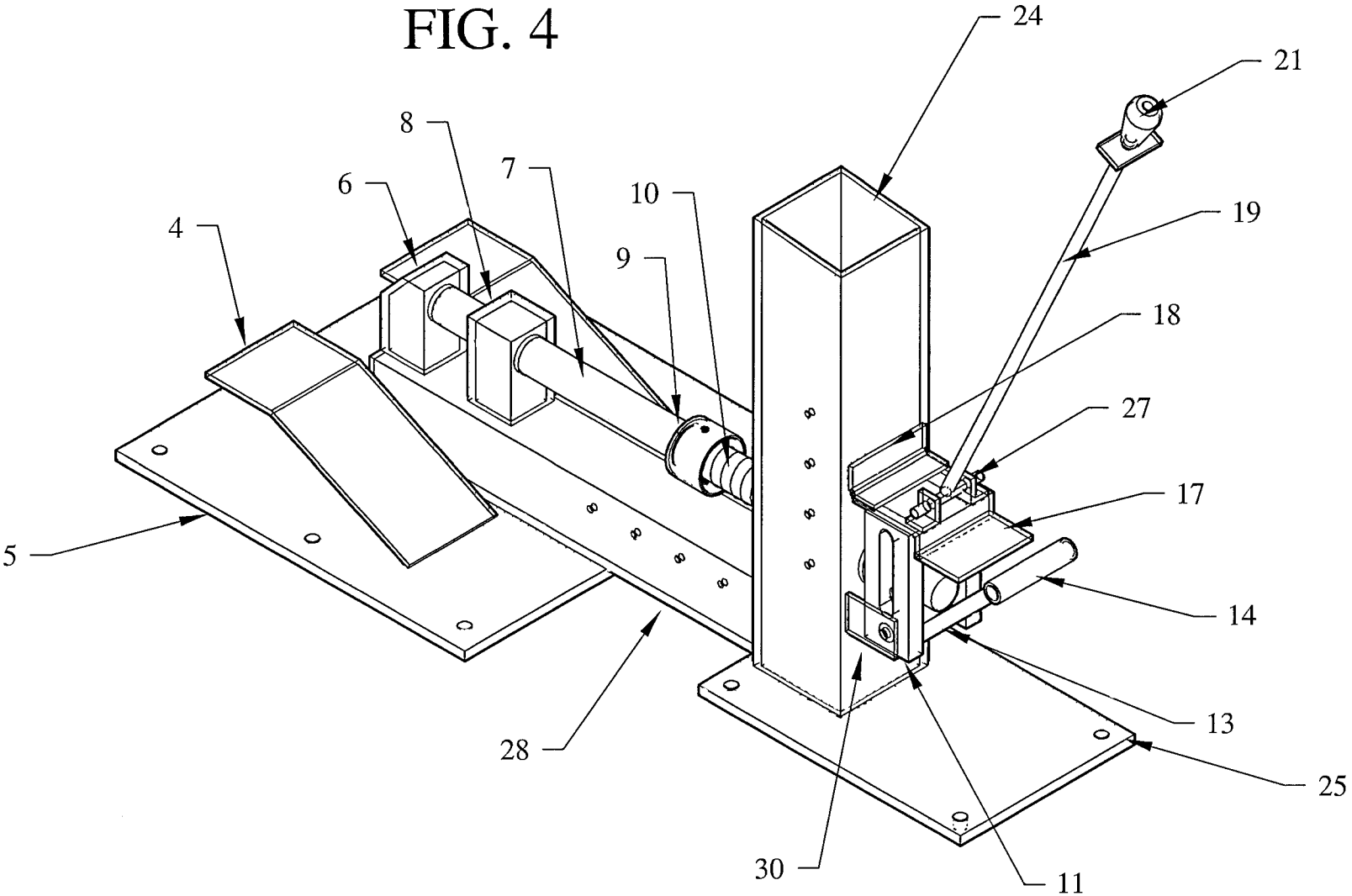
FIG. 4 is a perspective view of the locking mechanism depicted in FIG. 3, in accordance with embodiments of the present invention.

FIG. 4 is a perspective view of the locking mechanism depicted in FIG. 3, in accordance with embodiments of the present invention. The view of FIG. 4 depicts foot rest 4, front base plate 5, receiver socket 6, drive rod 7, guide socket 8, die spring cage 9, compression spring 10, drive cam 11, lever arm 13, foot pedal 14, cam lock 17, lock hinge 18, lock linkage 19, knob 21, seat pedestal 24, rear base plate 25, linkage pin 27, and center linking tube 28, which are included in the views described above relative to FIG. 3. The function of the aforementioned items depicted in FIG. 4 is included in the discussion presented above relative to FIG. 3. The view of FIG. 4 also depicts a cam pivot mount 30 for mounting the pivot 12 (see FIG. 3).

Figure 5:
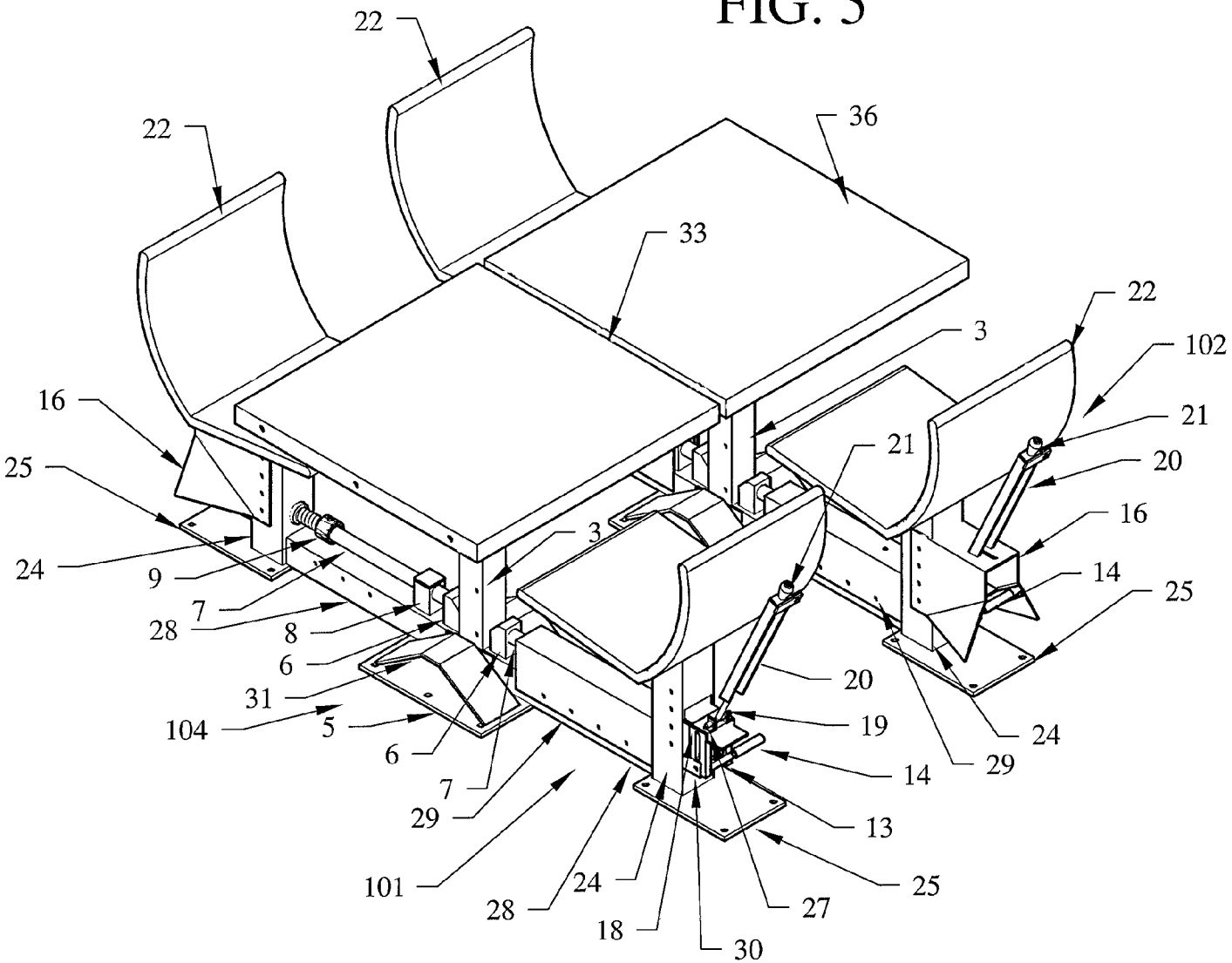
FIG. 5 is a perspective view of a table and seat assembly that includes multiple seats, in accordance with embodiments of the present invention.

The table and seat assembly described herein includes variations that include N seats, where N is greater than one. FIG. 5 is a perspective view of a table and seat assembly that includes four seats, in accordance with embodiments of the present invention. Multiple seat and table assembly 104 includes desk top pedestal 3, front base plate 5, receiver socket 6, drive rod 7, guide socket 8, die spring cage 9, lever arm 13, foot pedal 14, foot assembly cover 16, lock hinge 18, lock linkage 19, linkage cover 20, knob 21, seat 22, seat pedestal 24, rear base plate 25, linkage pin 27, center linking tube 28, actuating bolt cover 29, cam pivot mount 30, actuating bolt assembly 101, and locking mechanism 102, which are included in one of the views described above relative to FIG. 3 and FIG. 4.

The view of FIG. 5 also depicts a double foot rest 31, desk connectors 33 (a.k.a. desk spacers), and a dual desk top 36. Each double foot rest 31 supports the feet of two clients who are occupying opposing seats in the multiple seat and table assembly. Dual desk top 36 includes portions that are connected by desk connectors 33.

Each of the seats 22 in FIG. 5 is occupied by a corresponding client (not shown) who is wearing ankle shackles (not shown). Each of the clients has access to at least a portion of dual desk top 36. Each of the seats 22 in FIG. 5 includes a corresponding seat pedestal 24 and a corresponding linear sleeve bearing (not shown). The ankle shackles of each client may be secured by a corresponding locking mechanism 102. Not all locking mechanisms 102 are shown in FIG. 5, but each seat 22 is associated with a corresponding locking mechanism. One or more persons may operate the locking mechanisms 102. A person operating one of the locking mechanisms 102 secures the ankle shackles of a corresponding client by operating a corresponding foot pedal 14 to actuate a corresponding drive rod 7 to move the drive rod from an unlocked position to a locking position (i.e., move the drive rod through guide socket 8 so that it is received in receiver socket 6), and by operating a corresponding lock linkage 19 to lock the drive rod in the locking position, as described above relative to FIG. 3. When the drive rod 7 is locked in the locking position, the chain or other connecting means of the ankle shackles worn by the corresponding client is movable only between the drive rod 7 and a corresponding center linking tube 28, and between a corresponding guide socket 8 and a corresponding receiver socket 6.

Although FIG. 5 depicts four seats, the present invention contemplates embodiments in which any number of multiple seats (i.e., two or more seats) may be included in the table and seat assembly.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A table and seat assembly for limiting movement of connecting means of ankle shackles being worn by a first person, said table and seat assembly comprising:

a table including a first pedestal;

a seat including a second pedestal having a linear sleeve bearing, said seat being occupied by the first person, and said second pedestal connected to said first pedestal; and a locking mechanism including a drive rod having a portion in said linear sleeve bearing, a foot pedal for moving said drive rod from a first position to a second position, a receiver socket for receiving said drive rod, and a guide socket for guiding said drive rod to said receiver socket, wherein said foot pedal is configured for operation by a foot of a second person positioned behind the first person, wherein said drive rod in the first position is at least partially through said guide socket but not inside said receiver socket, wherein said drive rod in the second position is through said guide socket and inside said receiver socket, wherein said drive rod in the first position is for moving the connecting means of the ankle shackles downward between said guide socket and said receiver socket, and wherein said drive rod in the second position is for limiting the movement of the connecting means of the ankle shackles so that the connecting means cannot move upwards between said guide socket and said receiver socket.

2. The table and seat assembly of claim 1, wherein said foot pedal is mounted behind said second pedestal.

3. The table and seat assembly of claim 1, wherein said locking mechanism includes a compression spring for applying constant pressure on said drive rod to secure said drive rod in said receiver socket in the second position.

4. The table and seat assembly of claim 1, wherein said drive rod is spring loaded so that said drive rod rebounds to the second position.

5. The table and seat assembly of claim 1, wherein said locking mechanism includes a cam lock for locking said drive rod in the second position.

6. The table and seat assembly of claim 1, wherein said foot pedal is configured to be released by the foot of the second person to move said drive rod from the first position to the second position.

7. The table and seat assembly of claim 1, further comprising:

a drive cam for moving said drive rod between the first and second positions; and a cam lock for preventing movement of said drive cam and said drive rod in the second position.

8. The table and seat assembly of claim 7, further comprising:

a lock linkage for locking said cam lock; and a linkage pin connected to said lock linkage, wherein said lock linkage is configured to be pressed down to secure said linkage pin to said cam lock to prevent the movement of said drive cam.

9. The table and seat assembly of claim 8, wherein said lock linkage includes a hasp, wherein said hasp locked by a padlock secures said lock linkage from being lifted.

10. The table and seat assembly of claim 8, wherein said lock linkage is configured to be lifted by the second person while the foot of said second person is depressing said foot pedal in order to unlock said cam lock to move said drive rod to the first position.

11. The table and seat assembly of claim 1, further comprising a linking member connecting said first pedestal to said second pedestal, wherein said receiver socket and said guide socket are mounted on said linking member, wherein said drive rod in the second position is for limiting the movement of the connecting means of the ankle shackles by securing the connecting means between said drive rod and said linking member and between said receiving socket and said guide socket.

12. The table and seat assembly of claim 1, further comprising:

one or more other seats, each of said other seats including a corresponding pedestal having a corresponding linear sleeve bearing, and each of said other seats being occupied by a corresponding other person wearing ankle shackles having connecting means, wherein said table is configured to be accessible by said corresponding other person; and one or more other locking mechanisms in one-to-one correspondence with said one or more other seats, each of said one or more other locking mechanisms including a corresponding drive rod that includes a portion in said corresponding linear sleeve bearing, and further including a corresponding foot pedal, a corresponding receiver socket, and a corresponding guide socket, wherein said corresponding foot pedal is configured for operation by the foot of the second person positioned behind the corresponding other person to secure the ankle shackles worn by the corresponding other person by moving said corresponding drive rod from being at least partially through said corresponding guide socket but not inside said corresponding receiver socket to being through said corresponding guide socket and inside said corresponding receiver socket, thereby preventing the connecting means of the ankle shackles worn by the corresponding other person from being moved upwards between said corresponding guide socket and said corresponding receiver socket.

* * * * *